US006877625B2

(12) United States Patent
Alley

(10) Patent No.: US 6,877,625 B2
(45) Date of Patent: Apr. 12, 2005

(54) CONTAINER CLOSURE MEMBER WITH VENTED AND UNVENTED CLOSING POSITIONS

(76) Inventor: Matthew W. Alley, Mud City Loop, Morrisville, VT (US) 05661

( * ) Notice: Subject to any disclaimer, the term of this patent is extended or adjusted under 35 U.S.C. 154(b) by 58 days.

(21) Appl. No.: 09/968,655

(22) Filed: Oct. 1, 2001

(65) Prior Publication Data

US 2003/0062329 A1 Apr. 3, 2003

(51) Int. Cl.[7] ..... B65D 51/16
(52) U.S. Cl. ..... 215/307; 220/360; 220/253
(58) Field of Search ..... 215/307, 329, 215/310–314, 114; 220/253, 360, 366.1, 303, 667.1, 203.5, 203.9; 222/489, 486, 488, 568, 519, 522–537

(56) References Cited

U.S. PATENT DOCUMENTS 1,714,368 A * 5/1929 Hobson ..... 222/553
2,812,882 A * 11/1957 Osaka ..... 222/142.4
5,303,850 A 4/1994 Connan

FOREIGN PATENT DOCUMENTS

| | | | | |
|---|---|---|---|---|
| DE | 3 514 132 A1 | | 10/1986 | |
| EP | 350415 | * | 7/1989 | ..... 220/288 |
| GB | 1 463 209 | | 2/1977 | |
| GB | 2 024 160 A | | 1/1980 | |
| GB | 2 142 317 A | | 1/1985 | |
| WO | 00/02472 A2 | | 1/2000 | |

* cited by examiner

*Primary Examiner*—Lien Ngo
(74) *Attorney, Agent, or Firm*—Burr & Brown

(57) ABSTRACT

A closure member for a container, including a first member having a first set of threads with a predetermined pitch and a first orifice formed therethrough, and a second member having first and second sets of threads, both with the same pitch as the first set of threads of the first member, and a first orifice formed therethrough. When the threads of the first and second members are fully engaged, alignment between the first orifices formed through the first and second members occurs only when the first set of threads of the first member engages the first set of threads of the second member.

19 Claims, 3 Drawing Sheets

CONTAINER CLOSURE MEMBER WITH VENTED AND UNVENTED CLOSING POSITIONS

FIELD OF THE INVENTION

The present invention relates to a container closure member having vented and unvented closing positions, and, in particular, to a container closure member for a container whose interior requires selective exposure to the outside atmosphere.

BACKGROUND OF THE INVENTION

There are many different types of containers available today for holding or storing various types of materials and items. In almost all cases, the containers include a closure member designed to maintain the material or item within the interior of the container. In some cases, however, it is necessary to vent the container to the outside, while still holding the material or item itself within the confines of the container. In other cases, it is necessary to dispense material from the container in a metered fashion, but then provide for complete closure of the container.

One example of a container where it is necessary to vent the container to the outside, while still holding the material or item itself within the confines of the container, is a carrying case for a fly fishing rod. High-end fly rods can easily cost several hundred, if not thousand, dollars, and the owners of such fly rods typically store them in solid-walled containers to protect their investment. A fly rod is exposed to water when in use, and in some instances may even become submerged at least momentarily. During the initial storage period after such use, it is desirable to vent the carrying case to allow moisture to evaporate away from the fly rod, thereby preventing mildew and corrosion build up on the rod, as well as in the interior of the carrying case. After the rod is dry, however, it is desirable to close the case completely to prevent moisture from entering the case for the same reasons discussed above.

In the past, fly rod carrying cases have been sold with two closure members, one having vents and the other having no vents. During initial storage after use of the fly rod, the vented closure member is used, and then subsequently replaced with the unvented closure member. The main problem with this particular system is that one of the two closure members inevitably ends up being lost. Replacement can be difficult, as the original closure members usually come as a matching set. Additionally, it is cumbersome to carry two closure members for a single carrying case.

Another example where a vented closure member would be helpful is where a container is designed to hold particles or spheres of different size. It would be helpful to provide a single closure member that could not only completely close the container, but also allow selective metering of the contents of the container based only upon the size of the contents.

It would be advantageous to provide a single closure member that could function as both a vented closure member and an unvented closure member, at least in the instances described above. The present invention was developed with this in mind.

SUMMARY OF THE INVENTION

It is an object of the present invention to provide a closure member for a container that can function as both a vented closure member and an unvented closure member.

In accordance with one embodiment of the present invention, the closure member includes a first member having a first set of threads with a predetermined pitch and a first orifice formed therethrough, and a second member having first and second sets of threads, both with the same pitch as the first set of threads of the first member, and a first orifice formed therethrough. When the threads of the first and second members are fully engaged, alignment between the first orifices formed through the first and second members occurs only when the first set of threads of the first member engages the first set of threads of the second member.

BRIEF DESCRIPTION OF THE DRAWINGS

These and other objects of the present invention will be understood more fully after reading the following description taken in conjunction with the appended drawings wherein.

DETAILED DESCRIPTION OF THE PREFERRED EMBODIMENT

Figure 1:
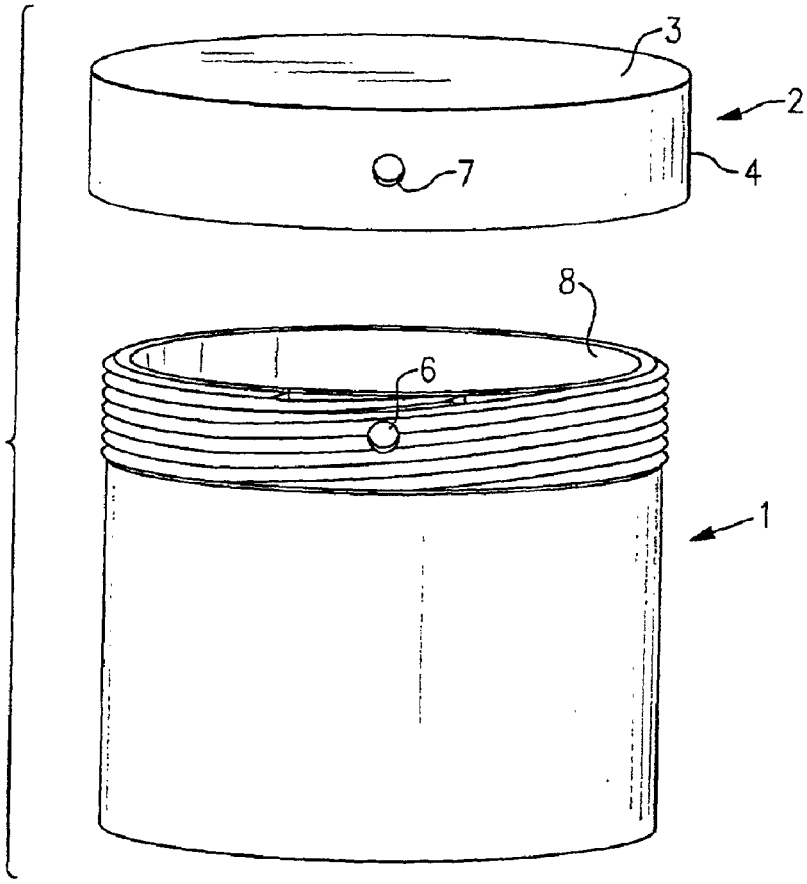
FIG. 1 is a perspective view of collar and cap members of one embodiment of the closure member in accordance with the present invention.

FIG. 1 is a perspective view of a closure member of one embodiment in accordance with the present invention. The closure member includes a collar 1 and a cap 2. In the illustrated embodiment, collar 1 is essentially a hollow cylinder, and cap 2 includes a top surface 3 with a sidewall 4 extending perpendicularly therefrom. Collar 1 can either be formed as a separate member or as an integral extension of the container to be closed. Cap 1 typically would be formed as a separate member, although the cap and collar could be molded integrally with some type of retainer chord extending therebetween. Such a retainer chord would maintain the cap in the proximity of the collar even when the cap is not actually threaded on the collar.

Figure 2:
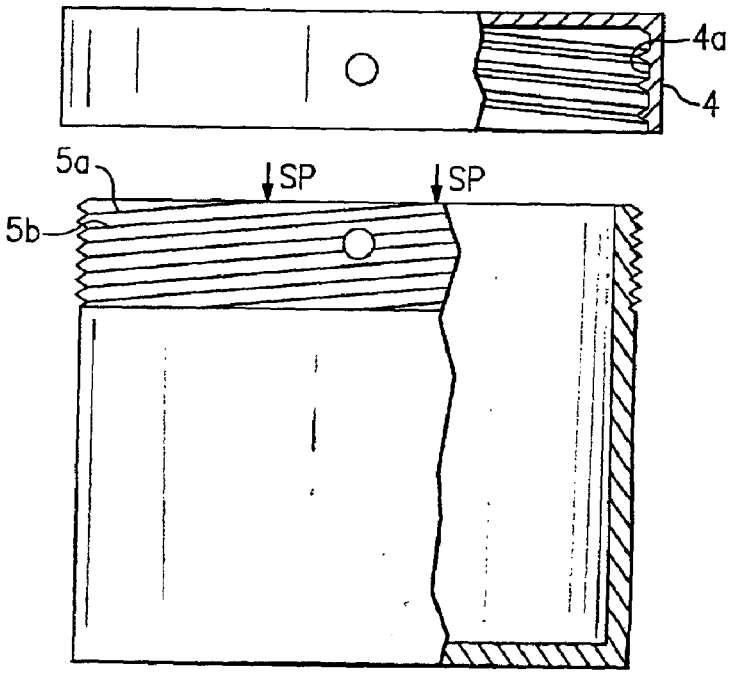
FIG. 2 is a partial sectional side view of the collar and cap members shown in FIG. 1.

FIG. 2 shows that threads are formed on the inner surface of sidewall 4 of cap 2 and on the outer surface of the upper portion of collar 1. The threads have the same pitch so that cap 2 can be screwed securely onto collar 1 to close the upper opening 8 formed therethrough. With collar 1 secured to the opening of a container, cap 2 can be used to close the container.

A first set of threads 4*a* is formed on the inner surface of sidewall 4 of cap 2. A complementary first set of threads 5*a* is formed on the upper portion of collar 1. A complementary second set of threads 5*b* also is formed on the upper portion of collar 1, but the starting point (SP) for the first set of threads 5*a* is radially out of phase with the starting point (SP) for the second set of threads 5*b*. Although FIG. 2 shows the starting points of each set of threads relatively close to one another, in practice, the spacing would likely be at least 90°.

The collar 1 has an orifice 6 passing therethrough, and cap 2 also has an orifice 7 passing therethrough. When the threads of cap 2 are fully engaged with the first set of threads 5*a* and the cap is completely tightened on collar 1, orifice 6 is in alignment with orifice 7. This allows cap 2 to maintain the bulk contents of the container within the interior space of the container, but at the same time allow metered communication of air between the interior of the container and the outside atmosphere. This arrangement would also allow metered dispensing of particles from the container, provided the size of the particles is smaller than the orifices.

In order to prevent communication between the interior of the container and the outside atmosphere, cap 2 would be removed and then re-engaged with the second set of threads 5*b*. Since the second set of threads 5*b* is out of phase with the first set of threads 5*a*, orifice 7 will not align with orifice 6 when cap 2 is closed completely on collar 1. Rather, orifice 7 will align with a region of the threaded portion of collar 1 that is spaced radially from orifice 6 roughly the same distance that the starting point (SP) of the first set of threads 5*a* is spaced from the starting point (SP) of the second set of threads 5*b*.

One exemplary method of manufacturing a closure member in accordance with the teachings of the present invention will now be explained.

The collar 1 and cap 2 can be formed by any suitable method (e.g., casting or injection molding). Once formed, a first set of threads having a pitch of, for example, 8 threads/inch is machined on the inner surface of sidewall 4 of cap 2. First and second sets of complementary threads, each having a pitch of 8 threads/inch, would then be formed on the upper portion of collar 1. The cap is placed on the collar so that the threads of the cap engage the first set of threads 5*a* on the collar. After the cap is tightened on the collar, a hole is drilled through the sidewall of the cap and the collar to thus form orifices 7 and 6, respectively. The cap should then be removed slowly to make note of the rotational position of the cap at the exact moment when the threads of the cap disengage the threads of the collar. Both the cap and collar should then be marked with appropriate indicia so that the user will know where to start the cap on the collar to achieve alignment of the orifices formed through the cap and collar. The closure member is now ready for use in the assembly of a container. To provide a sealed closure member, the cap would be removed and then retightened on the collar engaging the second set of threads 5*b* that was not used during the drilling operation to form the orifices.

In addition to the manufacturing steps described above, it is desirable to remove the cap after the drilling operation and bore orifice 7 to a diameter slightly larger than the diameter of orifice 6. This will insure alignment of the orifices even after the threads begin to wear from repeated use.

While the embodiment illustrated in FIGS. 1 and 2 make use of one set of threads on the cap and two sets of threads on the collar, it is possible to reverse the design and use two sets of threads on the cap and one set of threads on the collar. The former is preferred over the latter, however, as two sets of thread on the collar gives the impression of more holding power when compared to one set of threads of complementary pitch.

While the embodiment illustrated in FIGS. 1 and 2 also shows only one orifice formed in the collar and cap, it is possible to use a plurality of spaced holes in the cap with corresponding holes in the collar. Consideration must be given as to the radial offset used with respect to the starting points of the two sets of threads formed on the cap or collar. For example, if two diametrically opposed holes are formed in the cap and collar, then the two sets of threads formed on the cap or collar could not be 180 degrees out of phase. Rather, the two sets of threads should be, for example, 90 or 120 degrees out of phase.

Figure 3:
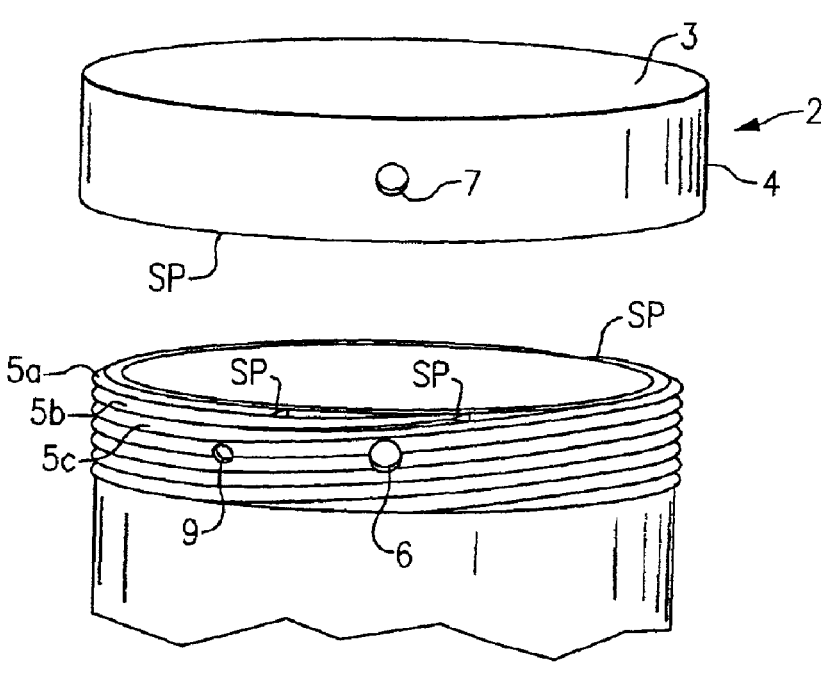
FIG. 3 is a perspective view of collar and cap components of another embodiment of the closure member in accordance with the present invention.

FIG. 3 shows that it is also possible to add a third set of threads 5*c* to collar 1 in order to provide a third tightened position for cap 2. In the embodiment illustrated in FIGS. 1 and 2, the two sets of threads provide two tightened positions for the cap on the collar. In the first tightened position (i.e., when the cap is threaded completely on the collar) the orifices are in alignment, while in the second tightened position, the orifices are not in alignment.

When a third set of threads is added to the collar interposed between the first 5*a* and second 5*b* sets of threads described above, the optimum spacing between the starting points of the three sets of threads would be 120 degrees. After the cap is tightened on the collar by engaging the third set of threads, a second orifice 9 could be drilled through the collar. The size of the first orifice 6 and second orifice 9 could be selected to provide different degrees of metering between the interior and exterior of the container on which the closure member is mounted. This type of closure member would be useful in applications where the release of substance from the interior of the container needs to be controlled/metered. For example, the container could contain particles of two different sizes and the appropriate orifice (6 or 9) could be selected to dispense one particle size and not the other. The size of orifice 7, of course, must be at least as large as the larger of the two orifices 6 and 9.

Figure 4:
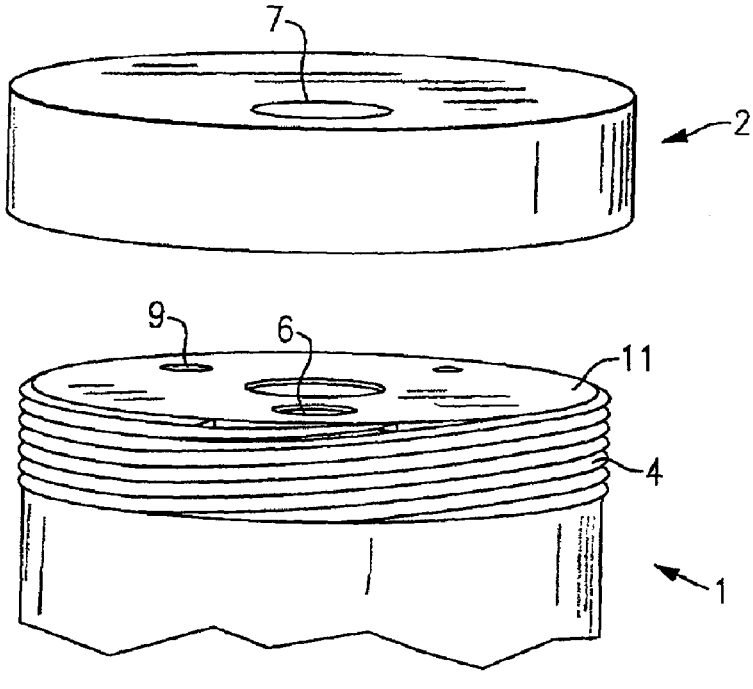
FIGS. 4–6 are perspective views of collar and cap components of yet another embodiments of the closure member in accordance with the present invention.
Figure 5:
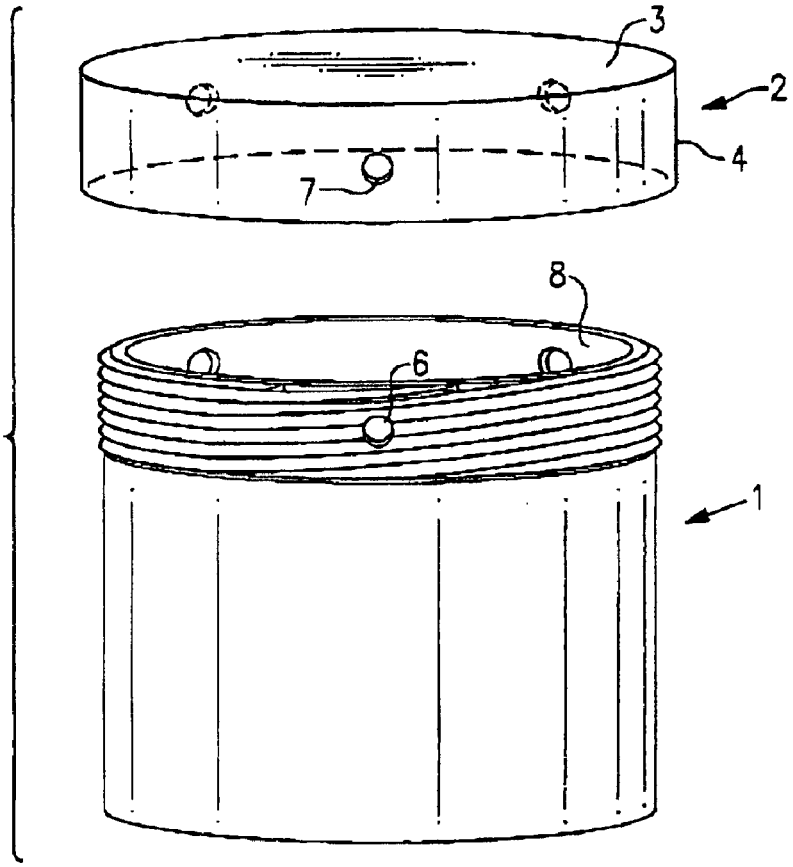
Figure 6:
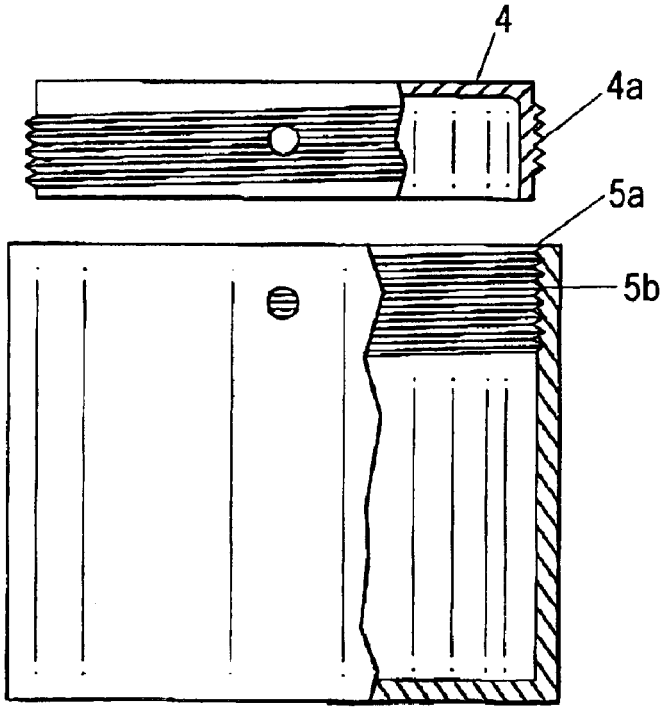

FIG. 4 shows another embodiment of the present invention where the orifices 6 and 9 are formed through an annular ring extension 11 of side wall 4. This design is particularly suitable where different sized particles are to be selectively dispensed from the container. Of course, if the cap were made to engage threads 5*a*, the cap would close the container altogether.

In all of the illustrated embodiments, the number of different sets of threads that can be formed on the collar (or cap in the reverse design described above) is limited only by the space available on the collar (or cap) and the pitch of threads used. In applications where the holding power between the cap and collar is not so high, several threads of very small pitch (e.g., 20 threads/inch) could be used in conjunction with a corresponding number of tightened positions for the cap on the collar. Where holding power is important, however, the pitch of the threads must be increased, which, in turn, decreases the number of sets of threads that can be formed on the collar (or cap).

While the present invention has been described with reference to preferred embodiments thereof, it will be understood by those skilled in the art that various modifications and the like could be made thereto without departing from the spirit and scope of the invention as defined in the appended claims.

What is claimed is:

1. A closure member for closing an opening in a container, comprising:

a first member having a first set of threads with a predetermined pitch and a first orifice formed therethrough; and a second member having first and second sets of threads, both with the same pitch as the first set of threads of said first member, and a first orifice formed therethrough;

wherein, when the threads of said first and second members are fully engaged, alignment between the first orifices formed through said first and second members occurs only when the first set of threads of said first member engages the first set of threads of said second member, and alignment between said first orifices formed through said first and second members does not occur when the first set of threads of said first member engages the second set of threads of said second member.

2. The closure member of claim 1, wherein said first and second members have a plurality of orifices formed therethrough, and alignment between those orifices occurs only when the first set of threads of said first member engage the first set of threads of said second member.

3. The closure member of claim 1, wherein said second member further comprises a third set of threads with the same pitch as said first and second sets of threads, and said first member further comprises a second orifice, having a size that differs from that of the first orifice formed therethrough, that aligns with the first orifice of said second member only when the first set of threads of said first member engages the third set of threads of said second member.

4. A closure member for closing an opening in a container, comprising:

a cap member having a first set of threads with a predetermined pitch and a first orifice formed therethrough; and a collar member defining the opening of the container, said collar member having first and second sets of threads, both with the same pitch as the first set of threads of said cap member, and a first orifice formed therethrough;

wherein, when the threads of said cap member and said collar member are fully engaged, alignment between the first orifices formed through said cap member and said collar member occurs only when the first set of threads of said cap member engages the first set of threads of said collar member, and alignment between said first orifices formed through said cap member and said collar member does not occur when the first set of threads of said cap member engages the second set of threads of said collar member.

5. The closure member of claim 4, wherein said cap member and said collar member have a plurality of orifices formed therethrough, and alignment between those orifices occurs only when the first set of threads of said cap member engage the first set of threads of said collar member.

6. The closure member of claim 4, wherein said collar member further comprises a third set of threads with the same pitch as said first and second sets of threads, and one of said cap member and said collar member further comprises a second orifice, having a size that differs from that of the first orifice formed therethrough, that aligns with the first orifice of said collar member or said cap member, respectively, only when the first set of threads of said cap member engage the third set of threads of said collar member.

7. The closure member of claim 4, wherein said cap member has a top surface and a cylindrical sidewall extending perpendicularly from the periphery of said top surface, and the first set of threads of said cap member is formed on said cylindrical sidewall.

8. The closure member of claim 7, wherein the first set of threads of said cap member is formed on an interior surface of said cylindrical sidewall, and the first and second sets of threads of said collar are formed on an exterior surface thereof.

9. The closure member of claim 7, wherein the first set of threads of said cap member is formed on an exterior surface of said cylindrical sidewall, and the first and second set of threads of said collar are formed on an interior surface thereof.

10. The closure member of claim 4, wherein the collar member is formed as an integral extension of the container.

11. The closure member of claim 4, wherein the collar member is formed separately from the container, and then secured to the container in the vicinity of the opening thereof.

12. A closure member for closing an opening in a container, comprising:

a collar member defining the opening of the container, said collar member having a first set of threads with a predetermined pitch and a first orifice formed therethrough; and a cap member having first and second sets of threads, both with the same pitch as the first set of threads of said collar member, and a first orifice formed therethrough;

wherein, when the threads of said cap member and said collar member are fully engaged, alignment between the first orifices formed through said cap member and said collar member occurs only when the first set of threads of said cap member engages the first set of threads of said collar member, and alignment between said first orifices formed through said cap and collar members does not occur when the first set of threads of said collar member engages the second set of threads of said cap member.

13. The closure member of claim 12, wherein said cap member and said collar member have a plurality of orifices formed therethrough, and alignment between those orifices occurs only when the first set of threads of said cap member engage the first set of threads of said collar member.

14. The closure member of claim 12, wherein said cap member further comprises a third set of threads with the same pitch as said first and second sets of threads, and one of said collar member and said cap member further comprises a second orifice, having a size that differs from that of the first orifice formed therethrough, that aligns with the first orifice of said cap member or said collar member, respectively, only when the first set of threads of said collar member engage the third set of threads of said cap member.

15. The closure member of claim 12, wherein said cap member has a top surface and a cylindrical sidewall extending perpendicularly from the periphery of said top surface, and the first set of threads of said cap member are formed on said cylindrical sidewall.

16. The closure member of claim 15, wherein the first and second sets of threads of said cap member are formed on an interior surface of said cylindrical sidewall, and the first set of threads of said collar are formed on an exterior surface thereof.

17. The closure member of claim 15, wherein the first and second sets of threads of said cap member are formed on an exterior surface of said cylindrical sidewall, and the first set of threads of said collar are formed on an interior surface thereof.

18. The closure member of claim 12, wherein the collar member is formed as an integral extension of the container.

19. The closure member of claim 12, wherein the collar member is formed separately from the container, and then secured to the container in the vicinity of the opening thereof.

* * * * *